United States Patent [19]

Hargrove et al.

[11] Patent Number: 4,803,841

[45] Date of Patent: Feb. 14, 1989

[54] MOISTURE SEPARATOR FOR STEAM TURBINE EXHAUST

[75] Inventors: Homer G. Hargrove, Maitland; George J. Silvestri, Jr., Winter Park, both of Fla.

[73] Assignee: Westinghouse Electric Corp., Pittsburgh, Pa.

[21] Appl. No.: 102,973

[22] Filed: Sep. 30, 1987

[51] Int. Cl.[4] ..... F01K 17/00

[52] U.S. Cl. ..... 60/657; 60/685; 60/646; 55/391; 55/396; 55/461; 55/473

[58] Field of Search ..... 60/646, 657, 685; 55/391, 396, 461, 473

[56] References Cited

U.S. PATENT DOCUMENTS 3,320,729 5/1967 Stahl .
3,902,876 9/1975 Moen et al. .
4,268,277 5/1981 Rooker .
4,355,515 10/1982 Cohen et al. .
4,527,396 7/1985 Silvestri, Jr. .
4,602,925 7/1986 Huffman .
4,622,819 11/1986 Draper et al. .
4,624,111 11/1986 Lang .
4,673,426 6/1987 Silvestri, Jr. .
4,699,114 10/1987 Giannotti ..... 55/396 X

*Primary Examiner*—Allen M. Ostrager

[57] ABSTRACT

A mosture pre-separator for the exhaust from a steam turbine, having an exhaust nozzle, comprises three cylindrical conduits. A first cylindrical conduit is affixed to the annular wall of the nozzle and has a radially outwardly extending section adjacent the annular wall, with a second cylindrical conduit, which terminates short of the annular wall, contained therein to form a first collection chamber therebetween. A third cylindrical conduit is slidably positioned in the second cylindrical conduit and extends into the exhaust nozzle of the turbine and forms a second collection chamber between the outer wall thereof and the wall of the exhaust nozzle, with direct communication provided between the first and second chambers. The third cylindrical conduit may have flow directing plates at the upper terminus thereof which extend outwardly towards the wall of the exhaust hood to remove the water film formed thereon and direct the film to be second collection chamber and then from the second collection chamber to the first collection chamber for draining therefrom.

22 Claims, 4 Drawing Sheets

MOISTURE SEPARATOR FOR STEAM TURBINE EXHAUST

CROSS-REFERENCE TO RELATED APPLICATION

Reference is made to copending U.S. patent application Ser. No. 087,940 filed Aug. 21, 1987 in the names of the present inventors and assigned to the assignee of the present invention which discloses an alternative apparatus for removing moisture from a turbine exhaust line.

BACKGROUND OF THE INVENTION

The present invention relates to steam turbines, such as high pressure steam turbines used in nuclear power plants, and specifically to a means for diminishing exhaust pipe erosion, as in the cross-under piping that connects the steam turbine exhaust hood and the moisture separator reheater.

The wet steam conditions associated with a nuclear steam turbine cycle have been observed to cause significant erosion/corrosion of cycle steam piping and components between the high pressure turbine exhaust and the moisture separator reheater.

The pattern, location and extent of cross-under piping erosion is a function of piping size, material and layout configuration, turbine exhaust conditions and plant load cycle. However, as a general rule, a base-loaded plant having carbon steel cross-under piping with typical nuclear high pressure turbine exhaust conditions of 12 percent moisture and 200 psia will experience, within 3 to 5 years after initial startup, erosion damage levels that require weld repair to restore minimum wall thickness. Such weld repairs are expensive and time-consuming to effect, and often result in extending planned outages. Occasionally cross-under piping erosion is the cause of an unscheduled outage.

In any event, weld repair of erosion/corrosion in cross-under piping is a very expensive proposition and the alternative approach of complete replacement of the eroded piping is even more expensive considering the time and logistics involved in such an undertaking.

Piping erosion is caused by moisture droplets impacting on the piping wall. The larger the droplet and the higher its velocity of impact, the greater the potential for mechanically removing metal from the piping wall.

Resistance to erosion is a function of the piping material's metallurgy. The carbon steel material generally favored for larger central station steam systems has an excellent service record under conventional fossil-fired steam cycle conditions, but have proven to be susceptible to erosion in nuclear reactor steam cycles. The use of more erosion resistant materials such as austenitic stainless steels, Inconel or carbon steels containing chrome or nickel are expensive alternatives.

Therefore, the incorporation of a device that could eliminate, reduce or control erosion in cross-over piping is certainly economically justifiable considering the cost of extended plant outages (especially unscheduled outages), weld repair costs and expensive alternative materials.

It is believed that most of the moisture droplets entrained in the steam leaving the high pressure turbine blading have an average diameter of less than 10 μm. The remaining twenty percent, or so, of the moisture is typified by droplets ranging from 100 μm to 200 μm or larger.

As described in U.S. Pat. No. 4,527,396, issued to George J. Silvestri, Jr., one of the present inventors, which is assigned to the assignee of the present invention and the contents of which are incorporated herein, by virtue of their geometry, nuclear steam turbine exhaust casings create vortices in the exiting wet steam. Such vortices have been observed in curved piping, where they are known as secondary flow patterns, as illustrated in FIGS. 1 to 5 of the aforementioned patent and described in the description relevant thereto. Thus, nuclear turbine exhaust casings, by creating vortices in the two phase flow, generate a centrifugal force field causing it to function as a centrifugal separator by forcing the heavier (bigger) water droplets to migrate, or drift, through the gas phase (steam) and be deposited on the exhaust casing wall. The extent of separation depends on the steam flow (velocity), exhaust casing geometry (primarily radius of curvature), and steam condition (pressure, temperature, quality). It has been calculated by considering the resulting centrifugal force and the resisting drag force under typical exhaust steam conditions that the relative velocity of moisture droplets 50 μm or bigger with respect to the steam will result in trajectories such that 20 to 30 percent of the total moisture present at the exit of the last blade row should be deposited on the exhaust casing walls. Therefore, considering the aforementioned droplet population distribution, most of the moisture droplets above 50 m in size must have been separated out and now appear as a water film on the exhaust casing walls. Hence, by trapping this film of water, the large, erosion causing droplets can substantially be removed, thus favorably altering the erosion potential of the steam exiting the high pressure turbine. Left alone, the water film on the casing walls becomes re-entrained into the steam flow at the juncture of the outlet nozzle and the exhaust casing proper, with the water film sheet being shattered into large droplets at this intersection. It is postulated that at steady state conditions, re-entrainment of this water film produces a definitive droplet size distribution and pattern which in turn leads to the observed distinctive erosion patterns downstream of the exhaust.

In short, the turbine exhaust casing provides separation of the erosion-causing fraction of the moisture, depositing these droplets as a film on the exhaust casing wall. By arranging to remove this film before it can be reentrained into the high pressure turbine exhaust steam as it passes into the outlet nozzle, cross-under piping erosion can be substantially curtailed if not altogether eliminated. Moisture pre-separators using this concept are referred to as "film-entrapment" type pre-separators.

The theory and principles of film entrapment pre-separators have been successfully demonstrated. The preseparator system for a steam turbine exhaust, described in U.S. Pat. No. 4,673,426 assigned to the assignee of the present invention, for example, was installed for tests in May–June 1984, with provisions for in-service performance testing using chemical tracer techniques. Subsequent testing in the September–October 1984 period revealed the target level of 20 percent of the moisture was being removed. However, there is ample evidence the pre-separator could likely be removing more than 20 percent, since the drains and drain collection plumbing were connected to existing plant vents and drains so as to promote the likelihood of causing the separated moisture to flash, thus reducing the effectiveness of the pre-separator. Further, the arrangement of the test injection and sampling locations did not assure complete and uniform mixing of the tracer, nor was a correction applied for flashing of separated water in the drain lines. Nevertheless, even though the tracer mixing and collected water flashing problems would tend to reduce the calculated system effectiveness, the pre-separator removed the targeted goal of 20 percent total entrained water. Equally interesting and important, the test results showed a pronounced difference in individual drain line flows, a not unexpected phenomenon, considering the existence of local vortices superimposed on the general curved path flow of the steam-water mixture in the turbine exhaust casing.

This completely in-turbine pre-separator has given no evidence of increased exhaust steam pressure loss as determined per heat rate tests, thus meeting one of the design goals.

In another installation, the in-turbine preseparator of said copending application was applied, except the pre-separator was built into a transition piping section at the base of the turbine which converted an obround turbine exhaust to the round cross-under piping geometry. This allowed the separated moisture collection "pocket" to be increased over that of the previously described system and, consequently, the use of fewer drain lines to transport the collected moisture to existing drain collection tanks. This larger collection pocket provided ample hold-up volume for generating the pressure head necessary to force the water into the drain lines, without the concern of overflowing the pre-separator pocket. Thus the residence time in the pre-separator collection pocket at that installation was increased over that available at the previous installation without causing an increase in cycle steam pressure drop due to narrowing of the cross-under piping geometry. Although test results are not definitive and the test procedure is not precise, the utility has reported 90 percent water removed. This figure is probably optimistic; however, it is abundantly clear, based on these two installations, that a film entrapment moisture pre-separator theory and practice is based on sound principles.

SUMMARY OF THE INVENTION

A moisture pre-separator is provided for the exhaust position of a steam turbine that has an exhaust hood with exhaust nozzles thereon. The pre-separator comprises three cylindrical conduits, with a first cylindrical conduit, affixed to the end annular wall of the nozzle, which has a radially outwardly extending section adjacent the wall and a cylindrical section which has an inner diameter greater than the inner diameter of the annular wall. A second cylindrical conduit is coaxially positioned in the first cylindrical conduit and aligned therein, such as by alignment pins, which second cylindrical conduit has an inlet end axially spaced from said annular wall of the nozzle, and an outlet end, with a first collection chamber formed between the first cylindrical conduit and second cylindrical conduit, and drain lines through the first cylindrical conduit to drain collected water therefrom. A third cylindrical conduit is positioned in the second cylindrical conduit and extends into the exhaust nozzle of the steam turbine, that forms a second collection chamber between the outer wall of the third cylindrical conduit and the exhaust nozzle. The second collection chamber communicates directly with the first collection chamber such that a substantial portion of the water flowing on the wall of the exhaust hood of the steam turbine flows into the second collection chamber and then directly into the first collection chamber from which it is drained.

Preferably, the third cylindrical conduit is slidably positioned within the second cylindrical conduit such that the upper terminus thereof may be closely positioned relative to the wall of the exhaust hood. In order to more closely provide desired spacing between the upper terminus of the third cylindrical conduit and the inner wall of the exhaust hood, flow directing plates may be provided on the terminus of that conduit, which extend radially outwardly towards the wall, or a flared upper terminal section may be provided on the third cylindrical conduit.

DETAILED DESCRIPTION

Figure 1:
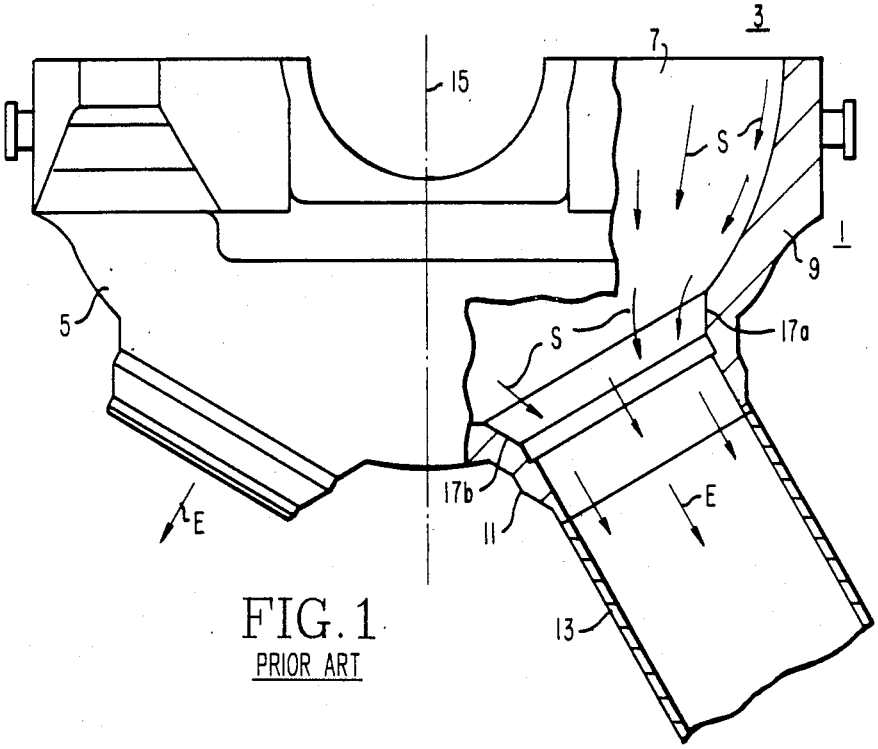
FIG. 1 PRIOR ART
FIG. 1 is an elevational view partly in section of the exhaust portion of a high pressure steam turbine.

A typical exhaust portion 1 of a high pressure steam turbine 3 is illustrated in FIG. 1. The exhaust portion 1 has an exhaust hood 5 which encloses an exhaust hood chamber 7. The exhaust hood 5 has a wall 9 through which there passes an exhaust nozzle 11, with an exhaust pipe 13 affixed thereto. The steam turbine is generally symmetrical about its center line 15. The wall 9 in FIG. 1 is broken away to show a portion of the exhaust hood chamber 7 and the nozzle 11 is illustrated in section view to more clearly show the typical path of high pressure steam as it approaches the exhaust nozzle 11. A portion of the steam flow within the steam turbine 3 is illustrated by the arrows S. Most of the entering flow follows the outside contour of the wall 9 as shown by the arrows S. Because of the placement of the nozzle 11 and the approaching flow indicated by the arrows S, the flow distribution into pipe 13 will be skewed and there will thus be higher rates of turning or change in direction at some locations within the nozzle 11 than at other locations. When a flow of gas is caused to bend, turn, or change its direction, the flow at the inner radius of the bend will have a higher rate of turning than at the outer radius of the bend. The magnitude of secondary flow, which comprises twin spirals, as discussed in U.S. Pat. No. 4,527,396, varies directly with the rate of turning of the fluid. As can be seen in FIG. 1, there are two regions 17*a*, 17*b*, which are analogous to pipe bends where the flow of steam is caused to make a sharper turn than at other regions in the vicinity of the nozzle 11. The flow of steam around region 17*a* is especially pronounced because the flow of steam in that particular region is forced to make a turn which is somewhat sharper than the flow in the region 17*b*. The reason for this, in the particular exemplary design illustrated in FIG. 1, is that a significant portion of the steam which is passing toward the nozzle 11 from the center line 15 of the turbine 3 can flow in a relatively straight path across the center line 15, whereas the steam flowing downwardly past region 17*a* is forced to make a more radical turn or change in direction in order to enter the nozzle 11. It would therefore be expected that the steam flowing around region 17*a* will develop more significant twin spirals of secondary flow. The exact location and direction of the spiral secondary flow will depend on the specific physical configuration of the turbine exhaust nozzle 11, the velocity of the high pressure steam, the relative affects of gravity and drag, the affects of adjacent flows of steam and various other physical variables. As the steam exits from the nozzle 11, it continues the spiral secondary flow as it passes in the general direction illustrated by arrows E through the exhaust piping toward the moisture separator reheater (not shown). It has been found that besides the secondary flow described above water builds up on the inner surface of the wall 9.

Figure 2:
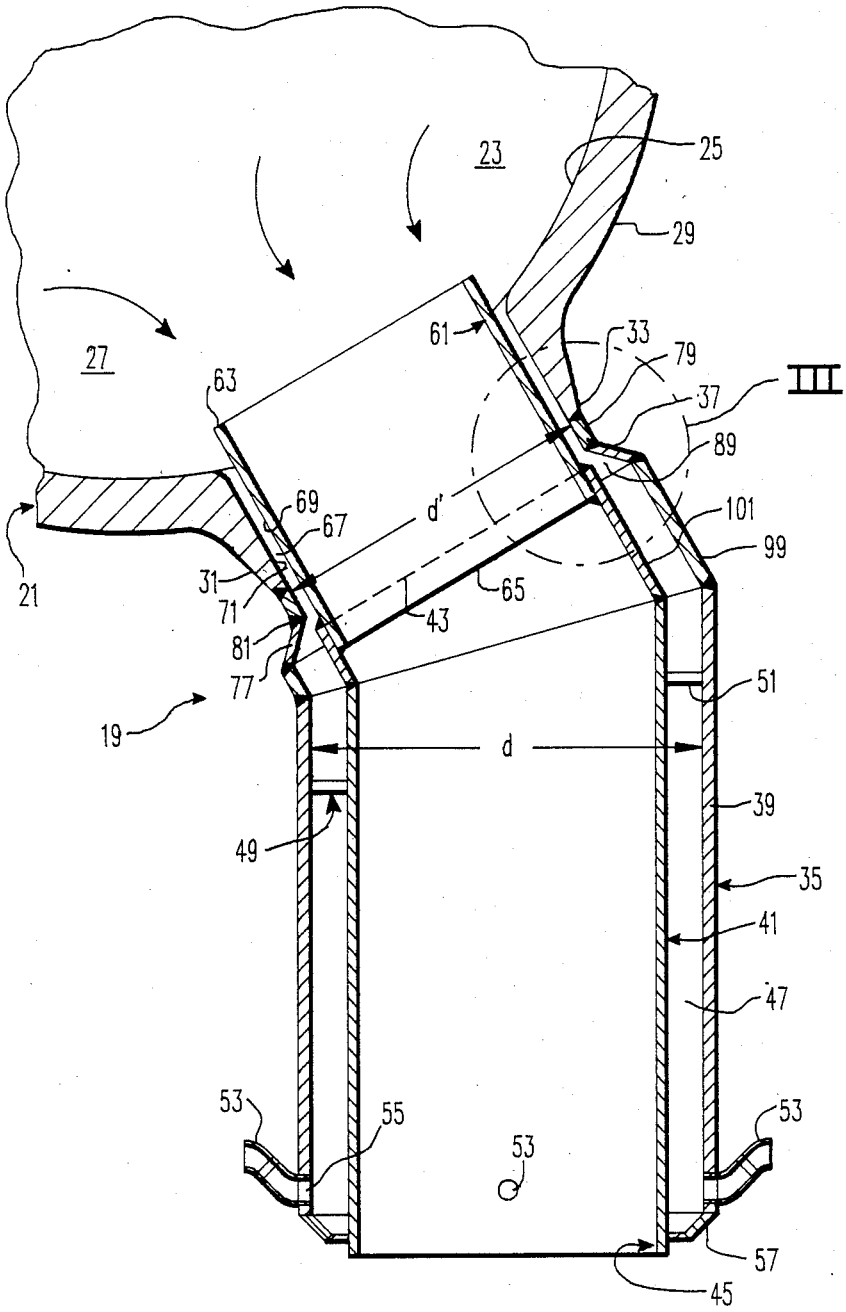
FIG. 2 is an elevational sectional view of the nozzle region of a high pressure steam turbine showing the moisture pre-separator of the present invention in position within the nozzle.
Figure 3:
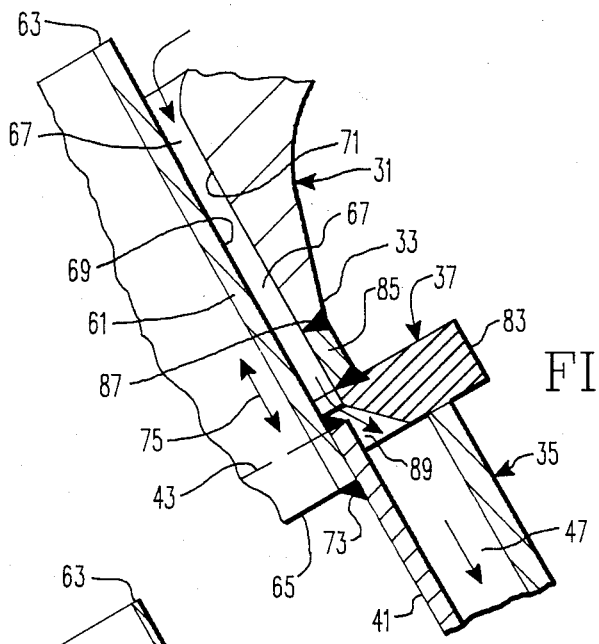
FIG. 3 is a view taken in the circle III of FIG. 2 with an embodiment of the moisture pre-separator having a ring member as the radially outwardly extending section of the first cylindrical conduit, showing the flow path of liquid to the first collection chamber.
Figure 4:
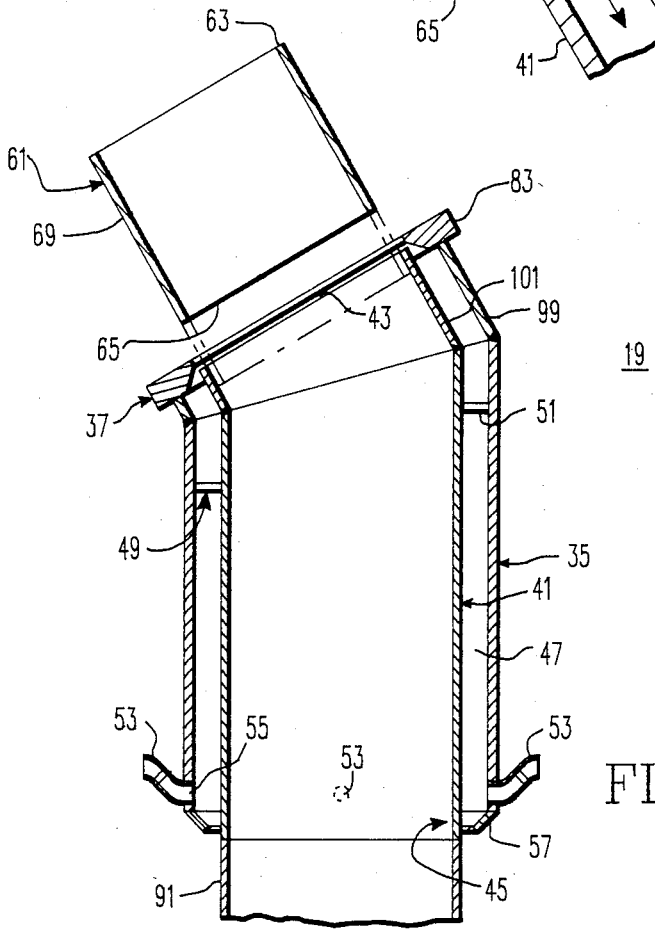
FIG. 4 is an exploded sectional view of the moisture pre-separator of the present invention prior to assembly within the nozzle of a high pressure steam turbine.

Referring now to FIGS. 2, 3 and 4, a moisture preseparator 19 for an exhaust portion 21 of a steam turbine 23 which includes an exhaust hood 25 enclosing an exhaust hood chamber 27 is illustrated, which has a wall 29 through which there passes an exhaust nozzle 31, the nozzle terminating as an annular wall 33. The moisture preseparator separator 19 comprises a first cylindrical conduit 35 that is affixed in sealing relationship to the annular wall 33 of the exhaust nozzle 31. The first cylindrical conduit 35 has a radially outwardly extending section 37 adjacent to the annular wall 33 and a cylindrical wall section 39 extending from the radially outwardly extending section 37. The cylindrical wall section 39 of the first cylindrical conduit 35 is of a diameter d which is larger than the diameter d' of the annular wall 33. A second cylindrical conduit 41 is coaxially positioned within the first cylindrical conduit 35. The second cylindrical conduit 41 has an inlet end 43 that is axially spaced from the annular wall 33 of the exhaust nozzle 31 and an outlet end 45, so as to form a first collection chamber 47 between the first cylindrical conduit 35 and the contained second cylindrical conduit 41. Alignment means 49, such as pins 51, are provided to space the first and second cylindrical conduits 35 and 41 in a coaxial relationship, while drain lines 53 are provided, having an upwardly disposed S-shape to provide a water seal, attached to openings 55 in the first cylindrical conduit 35, adjacent a bottom wall 57 that closes the lower portion of the chamber 47 between first and second cylindrical conduits 35 and 41, to drain condensate from chamber 47.

A third cylindrical conduit 61 is preferably slidably positioned within the second cylindrical conduit 41, adjacent the inlet end 43 thereof, with the upper terminus 63 thereof extending into the exhaust nozzle 31 of the exhaust portion 21 of the steam turbine 23, and the lower terminus 65 thereof terminates within the confines of the second cylinder 41. A second collection chamber 67 is formed between the outer surface 69 of the third cylindrical conduit 61 and the inner surface 71 of the exhaust nozzle 31, which second collection chamber 67 communicates directly with the first annular chamber 47.

As illustrated in FIG. 3, when the correct positioning of the third cylindrical conduit has been effected, with the upper terminus thereof correctly positioned, the lower terminus 65 is welded, as indicated at 73 to secure the same in said position. Thus, the third cylindrical conduit may be slidable, as indicated by arrow 75 in FIG. 3 and secured only after the exact desired positioning is achieved.

As indicated, the radially outwardly extending section of said first cylindrical conduit may be in the form of a flared section 77 (FIG. 2) affixed to the annular wall 33 of said nozzle, through an extension 79 thereof such as by welding 81, or in the form of a ring member 83 (FIG. 3) that is affixed to the annular wall 33 of the exhaust nozzle 31, such as by a flange 85 welded to said annular wall, as indicated at 87.

A gap 89 is provided between the third cylindrical conduit 61 and the first cylindrical conduit 35 which provides direct communication between the second collection chamber 67 and first collection chamber 47.

The cross-under piping 91 (FIG. 4), is secured to the bottom wall 57 which closes the lower portion of the first annular chamber 47.

The second cylindrical conduit 41 has an inner diameter and outer diameter closely approximating the exhaust pipe 31, or cross-under piping section removed, thus only slightly reducing the cycle steam cross-sectional flow path. The inlet end 43 of the second cylindrical conduit 41 does not extend up to the annular wall 33 of the exhaust nozzle 31, that is, the second cylindrical conduit is shorter than the original cross-under pipe or exhaust pipe. This provides an opening or gap 89 at the top of the assembly between the first and the second and third cylindrical conduits 35, 41 and 61 creating a direct passage for collected condensate from the inner wall of the exhaust hood 29 to flow from the second collection chamber 67 to the first collection chamber 47. Also, the shorter second cylindrical conduit 41 provides a means for access to the backside of weldment joining this assembly to the turbine exhaust nozzle annular wall 33.

The third cylindrical conduit 61 has an outer diameter that mates in sliding contact with the inner diameter wall of the second cylindrical conduit 41 and extends into the turbine exhaust nozzle 31 an appropriate distance so as to form a dam for intercepting the water film on the inner surface of the wall 29 of the exhaust hood. The diametrical dimension of the third cylindrical conduit 61 is such that by mating with the inner diameter of the second cylindrical conduit 41, the second collection chamber 67 is formed. The second annular chamber 67 serves as a flow passage for directing the intercepted water film on the turbine exhaust hood wall 29 down into the first collection chamber 47. Sufficient sliding contact area between the third cylindrical conduit 61 and the second cylindrical conduit 41 is provided so as to permit axial adjustment of the third cylindrical conduit 61 to position the same for properly intercepting the water film while, at the same time, maintaining sufficient contact with the second cylindrical conduit 41 for proper welding. This adjustment feature allows for dimensional variation in individual nozzles and turbines.

A typical width of the second collection chamber 67 is expected to be about one half inch. For a typical third cylindrical conduit 61 wall thickness of one half inch, the flow area reduction for the cycle steam through the third cylindrical conduit 61 is about 11 percent (based on a turbine exhaust nozzle 31 inner diameter of 36 inches). Such a flow reduction over the short length of the third cylindrical conduit 61 has virtually no influence on increasing cycle steam pressure drop due to acceleration/deceleration of the cycle steam flow. The flow area reduction for cycle steam flow through the second cylindrical conduit 41 is approximately 5 percent and again has an inconsequential influence on cycle steam pressure drop.

Typical velocities of the skimmed condensate at expected maximum operating conditions through the second collection chamber 67 is calculated to be slightly in excess of 1 ft/sec., a value well within the 2 ft/sec. guideline for saturated fluid drains. Moreover, the pressure recovery realized by intercepting the film is calculated to be in excess of that needed to prevent flashing of the skimmed condensate as it passes from the turbine exhaust hood wall 29 through the second collection chamber 67 and into the first collection chamber 47.

Figure 5:
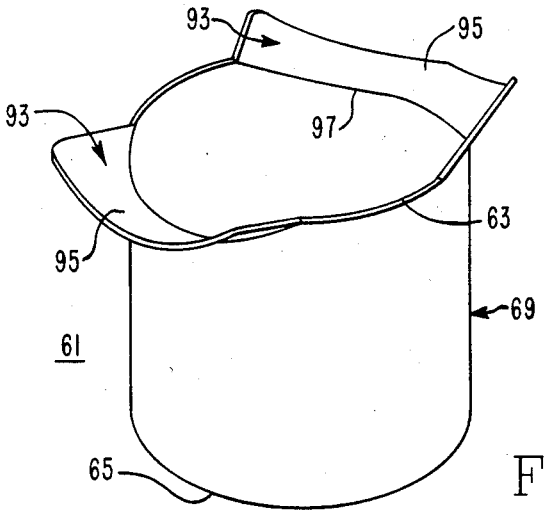
FIG. 5 is a perspective view of another embodiment of the third cylindrical conduit used in the present moisture pre-separator having deflection means at the upper terminus thereof.
Figure 6:
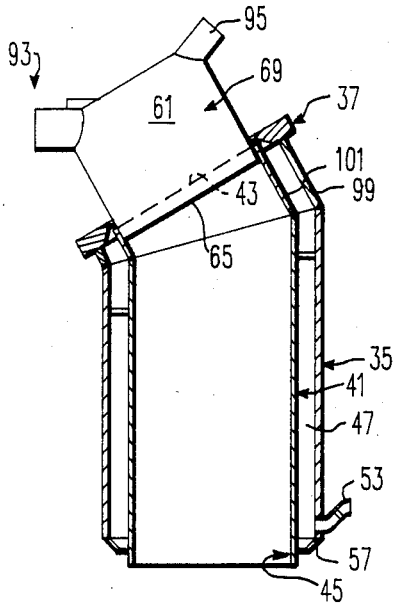
FIG. 6 is a partial sectional view of the third cylindrical member of FIG. 5 assembled in the moisture preseparator of the present invention.
Figure 7:
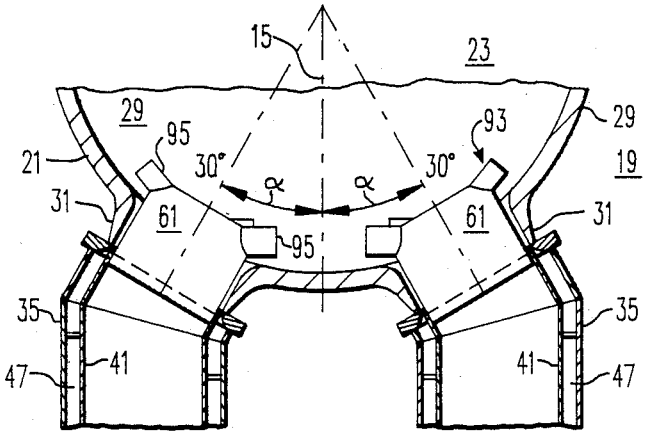
FIG. 7 is a partial sectional view of a pair of moisture pre-separators of FIG. 6 assembled in a pair of nozzles of a high pressure steam turbine.

In the embodiment of the moisture pre-separator illustrated in FIGS. 5 to 7, the third cylindrical conduit 61 is provided, at the upper terminus 63 thereof, with flow direction means 93, such as outwardly directed flow directing plates 95, the plates 95 secured thereto such as by welding 97.

The flow direction means 93 is used where the configuration of the exhaust chamber wall 29 surfaces, in the region of the nozzle 31, require that the terminus 63 of the third cylindrical conduit 61 be trimmed in a precise but irregular pattern to achieve a proper gap (about ¾ inch) between the third cylindrical conduit 61 and the wall 29 everywhere around the circumference of the upper nozzle opening. The use of the flow direction means 93 forms a contoured inlet with the turbine wall 29 at all locations where the water film is flowing in a non-vertical direction (with respect to the exhaust nozzle 31) in the vicinity of the exhaust nozzle. The function of the flow direction means 93 is to capture the water film present on the wall 29 directing the water film into the second collection chamber 67 and prevent the film from separating from the wall 29 as it approaches the nozzle 31. Otherwise, the film could become detached from the wall 29 and become reentrained in the main stream of the steam flow.

Figure 8:
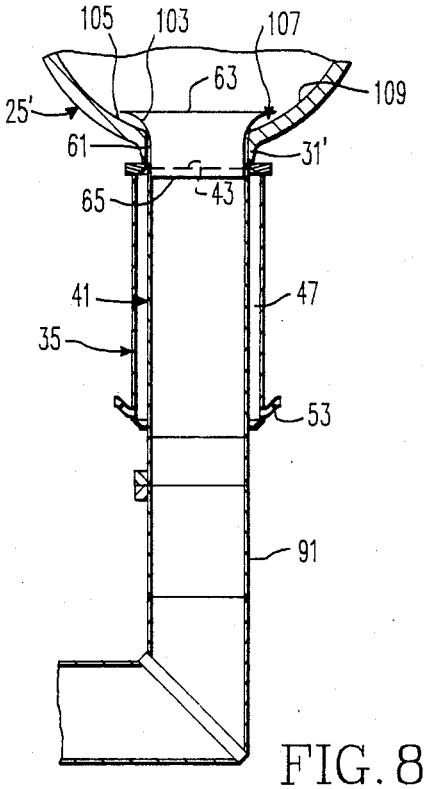
FIG. 8 is a sectional view of a moisture preseparator of the present invention assembled with a high pressure steam turbine having a vertically disposed nozzle.

The moisture pre-separators illustrated in FIGS. 2 to 7 are used in steam turbines where the exhaust nozzle 31 extends at an angle from the center line of the steam turbine. As shown (FIG. 6), upper portion 99 of the first cylindrical conduit, and the upper portion 101 of the second cylindrical conduit may be angularly displaced from the remainder of said cylindrical conduits to provide abutment to the nozzle 31, in an exhaust hood 25, while said remainder is substantially vertically disposed. The present moisture pre-separator is also usable with a vertically disposed nozzle 31', as shown in FIG. 8. As illustrated therein, the third cylindrical conduit 61 is provided with a flared upper terminal section 103 which is directed towards but terminates at 105, at a location so as to provide a gap 107 between the terminus 105 thereof and the inner wall 109 of the exhaust hood 25' adjacent the nozzle 31'.

In the present pre-separator, because the first collection chamber 47 is external to the exhaust portion 21 of the turbine, there is now far less limitation in collection volume size. Typically collection volumes may be sized to provide at least 4 seconds holdup time and the annular flow area within the collection chamber sized so that typically only two or three drain lines of typically four to six inch size need be provided to properly drain the unit. All known potential applications can meet the above criteria by using about a 2 inch wide first collection chamber 47 between the second cylindrical conduit 41 outer diameter and the inner diameter of the first cylindrical conduit 35, and about a 4 to 5 foot long first collection chamber 47. Moreover, the relationship (orientation) of the drain lines 53 is not critical, because the increased first collection chamber 47 volume provides additional margin for preventing pre-separator overflow due to pressure flow inbalance creating widely varying water levels in the first collection chamber. Therefore, although it is preferred practice to uniformly space the drain lines around the circumference of the preseparator, non-uniform spacing is tolerated.

Pre-separators are primarily intended for backfitting to existing nuclear turbine installations. As such, the number, size, and orientation of the required drain lines has a major impact on installation cost and time, since invariably these drains must be integrated with existing plant piping and structural framework. The previous in-turbine pre-separator of U.S. Pat. No. 4,673,426 with its small condensate collection volume plus the close proximity of the drain openings to the skimmer entrance provided little margin against steam bypass. The preseparator of the present invention addresses this problem by locating the drain openings 55 at the bottom of the first collection chamber 47 and providing an external piping water seal in the drain lines 53, due to the upwardly disposed S-shape thereof, to assure the drain openings are not uncovered during operation and thus steam bound.

The pre-separator of the present invention does not require dismantling or extensive machining of the high pressure turbine or exhaust nozzle to effect installation and provides improved flow paths and collection chambers for the condensate separated from the steam. Also, for retrofit application usually encountered, the present construction permits use of fewer drain lines from the preseparator into the collection piping headers.

What is claimed is:

1. A moisture pre-separator for an exhaust portion of a steam turbine including an exhaust hood having a wall and an exhaust nozzle passing therethrough, said exhaust nozzle terminating as an annular wall, comprising;

a first cylindrical conduit affixed in sealing relationship to said annular wall, said first cylindrical conduit having a radially outwardly extending section adjacent said annular wall, and a cylindrical wall section larger in diameter than said annular wall, extending from said radially outwardly extending wall section;

drain lines on the cylindrical wall section of said first cylindrical conduit for draining water therethrough;

a second cylindrical conduit coaxially positioned within said first cylindrical conduit having an inlet end and outlet end, the inlet end spaced from the annular wall of said nozzle, whereby a first collection chamber is formed between said first and second cylindrical conduits;

a third cylindrical conduit positioned within said second cylindrical conduit extending into said exhaust nozzle to form a second collection chamber between said third cylindrical conduit and said exhaust nozzle, said second collection chamber directly communicating with said first collection chamber; and a bottom wall between said first and second cylindrical conduits closing the lower portion of said first collection chamber, such that a substantial portion of the water flowing on the wall of said exhaust hood flows into said second collection chamber and then directly into said first collection chamber and is drained through said drain lines.

2. The moisture pre-separator for the exhaust portion of a steam turbine as defined in claim 1 wherein said third cylindrical conduit is slidably positioned within said second cylindrical conduit.

3. The moisture pre-separator for the exhaust portion of a steam turbine as defined in claim 1 wherein said radially outwardly extending section of said first cylindrical conduit comprises a ring member affixed to the annular wall of said nozzle.

4. The moisture pre-separator for the exhaust portion of a steam turbine as defined in claim 1 wherein said radially outwardly extending section of said first cylindrical conduit comprises a flared section of said first cylindrical conduit adjacent the annular wall of said nozzle.

5. The moisture pre-separator for the exhaust portion of a steam turbine as defined in claim 1 wherein alignment means are provided between said first and second cylindrical conduits, extending across said first collection chamber, to space said cylindrical conduits in a coaxial relationship.

6. The moisture pre-separator for the exhaust portion of the steam turbine as defined in claim 5 wherein said alignment means comprise alignment pins extending across said first collection chamber.

7. The moisture pre-separator for the exhaust portion of a steam turbine as defined in claim 1 wherein said third cylindrical conduit has, at the upper terminus thereof extending into said exhaust nozzle, flow direction means extending outwardly towards the wall of said exhaust hood adjacent said nozzle.

8. The moisture pre-separator for the exhaust portion of a steam turbine as defined in claim 7 wherein said flow direction means comprises flow directing plates secured to the terminus of said third cylindrical conduit.

9. The moisture pre-separator for the exhaust portion of a steam turbine as defined in claim 7 wherein said flow direction means comprises a flared upper terminal section on said third cylindrical conduit.

10. The moisture pre-separator for the exhaust portion of a steam turbine as defined in claim 1 wherein said first and second cylindrical conduits have upper coaxial portions thereof which are angularly displaced from the remainder of said first and second cylindrical conduits.

11. A moisture pre-separator for an exhaust portion of a steam turbine including an exhaust hood having a wall and an exhaust nozzle passing therethrough, said exhaust nozzle terminating as an annular wall, comprising:

a first cylindrical conduit affixed in sealing relationship to said annular wall, said first cylindrical conduit having a radially outwardly extending section adjacent said annular wall, and a cylindrical wall section larger in diameter than said annular wall, extending from said radially outwardly extending wall section;

drain lines on the cylindrical wall section of said first cylindrical conduit for draining water therethrough;

a second cylindrical conduit coaxially positioned within said first cylindrical conduit having an inlet end and outlet end, the inlet end spaced from the annular wall of said nozzle, whereby a first collection chamber is formed between said first and second cylindrical conduits;

alignment means between said first and second cylindrical conduits, extending across said first collection chamber, to space said cylindrical conduits in a coaxial relationship;

a third cylindrical conduit slidably positioned within said second cylindrical conduit extending into said exhaust nozzle to form a second collection chamber between said third cylindrical conduit and said exhaust nozzle, said second collection chamber directly communicating with said first collection chamber; and a bottom wall between said first and second cylindrical conduits closing the lower portion of said first collection chamber, such that a substantial portion of the water flowing on the wall of said exhaust hood flows into said second collection chamber and then directly into said first collection chamber and is drained through said drain lines.

12. The moisture pre-separator for the exhaust portion of a steam turbine as defined in claim 11 wherein said radially outwardly extending section of said first cylindrical conduit comprises a ring member affixed to the annular wall of said nozzle.

13. The moisture pre-separator for the exhaust portion of a steam turbine as defined in claim 11 wherein said radially outwardly extending section of said first cylindrical conduit comprises a flared section of said first cylindrical conduit adjacent the annular wall of said nozzle.

14. The moisture pre-separator for the exhaust portion of the steam turbine as defined in claim 11 wherein said third cylindrical conduit has secured to the upper terminus thereof, extending into said exhaust nozzle, flow directing plates extending outwardly towards the wall of said exhaust hood adjacent said nozzle.

15. The moisture pre-separator for the exhaust portion of the steam turbine as defined in claim 11 wherein said third cylindrical conduit has a flared upper terminal section, at the upper terminus thereof, extending outwardly towards the wall of said exhaust hood adjacent said nozzle.

16. In a steam turbine having an exhaust portion which includes an exhaust hood with a wall and an exhaust nozzle passing therethrough, said exhaust nozzle terminating as an annular wall, the improvement comprising:

a first cylindrical conduit affixed in sealing relationship to said annular wall, said first cylindrical conduit having a radially outwardly extending section adjacent said annular wall, and a cylindrical wall section larger in diameter than said annular wall, extending from said radially outwardly extending wall section;

drain lines on the cylindrical wall section of said first cylindrical conduit for draining water therethrough;

a second cylindrical conduit coaxially positioned within said first cylindrical conduit having an inlet end and outlet end, the inlet end spaced from the annular wall of said nozzle, whereby a first collection chamber is formed between said first and second cylindrical conduits;

alignment means between said first and second cylindrical conduits, extending across said first collection chamber, to space said cylindrical conduits in a coaxial relationship;

a third cylindrical conduit positioned within said second cylindrical conduit extending into said exhaust nozzle to form a second collection chamber between said third cylindrical conduit and said exhaust nozzle, said second collection chamber directly communicating with said first collection chamber; and a bottom wall between said first and second cylindrical conduits closing the lower portion of said first collection chamber, such that a substantial portion of the water flowing on the wall of said exhaust hood flows into said second collection chamber and then directly into said first collection chamber and is drained through said drain lines.

17. The steam turbine as defined in claim 16 wherein said radially outwardly extending section of said first cylindrical conduit comprises a ring member affixed to the annular wall of said nozzle.

18. The steam turbine as defined in claim 16 wherein said radially outwardly extending section of said first cylindrical conduit comprises a flared section of said first cylindrical conduit adjacent the annular wall of said nozzle.

19. The steam turbine as defined in claim 16 wherein said exhaust nozzle extends at an angle from the center line of said steam turbine, and said first and second cylindrical conduits have upper coaxial portions thereof which are angularly displaced from the remainder of said first and second cylindrical conduits, said remainder of said first and second conduits being substantially vertical.

20. The steam turbine as defined in claim 16 wherein said third cylindrical conduit has, at the upper terminus thereof, extending into said exhaust nozzle, flow direction means extending outwardly towards the wall of said exhaust hood adjacent said nozzle.

21. The steam turbine as defined in claim 16 wherein said flow direction means comprises flow directing plates secured to the terminus of said third cylindrical conduit.

22. The steam turbine as defined in claim 16 wherein said flow direction means comprises a flared upper terminal section on said third cylindrical conduit.

* * * * *